US005551638A

United States Patent [19]

Caley

[11] Patent Number: 5,551,638

[45] Date of Patent: Sep. 3, 1996

[54] VALVE MEMBER FOR FUEL INJECTION NOZZLES

[75] Inventor: David J. Caley, Sorrento, Australia

[73] Assignee: Orbital Engine Company (Australia) Pty. Limited, Balcatta, Australia

[21] Appl. No.: 256,356

[22] PCT Filed: Feb. 17, 1993

[86] PCT No.: PCT/AU93/00074

§ 371 Date: Jul. 19, 1994

§ 102(e) Date: Jul. 19, 1994

[87] PCT Pub. No.: WO93/16282

PCT Pub. Date: Aug. 19, 1993

[30] Foreign Application Priority Data

Feb. 17, 1992 [AU] Australia ..... PL0913

[51] Int. Cl.[6] ..... B05B 1/32

[52] U.S. Cl. ..... 239/453; 239/533.9; 239/533.12

[58] Field of Search ..... 239/533.3, 533.7, 239/533.11, 533.12, 585.3, 585.5, 451–453

[56] References Cited

U.S. PATENT DOCUMENTS

| | | | |
|---|---|---|---|
| 1,755,192 | 4/1930 | Scott | 239/533.7 |
| 3,069,099 | 12/1962 | Graham | 239/453 |
| 4,270,257 | 6/1981 | Kimata et al. | 239/453 X |
| 4,394,970 | 7/1983 | Hofmann et al. | 239/453 |
| 4,408,722 | 10/1983 | Frelund | 239/453 |
| 4,497,443 | 2/1985 | Sauer | 239/533.3 |
| 4,932,591 | 6/1990 | Cruz | 239/518 X |

FOREIGN PATENT DOCUMENTS

| | | | |
|---|---|---|---|
| 2501295 | 9/1982 | France | 239/533.12 |
| 2023227 | 12/1979 | United Kingdom | 239/533.3 |
| 9111609 | 8/1991 | WIPO | 239/533.12 |

*Primary Examiner*—Andres Kashnikow
*Assistant Examiner*—Lesley D. Morris
*Attorney, Agent, or Firm*—Nikaido Marmelstein Murray & Oram LLP

[57] ABSTRACT

An injector nozzle for a fuel injected internal combustion engine having a selectively openable nozzle for the delivery of fuel to the engine combustion chamber, the nozzle comprising a port having an internal annular surface and a valve member having an external annular surface coaxial with respect to the internal annular surface of the port. The valve member being axially movable relative to the port to selectively provide an annular passage therebetween for the delivery of the fuel or sealed contact therebetween to prevent the delivery of fuel. The valve member has a coaxial projection extending beyond the extremity of the external annular surface and positioned so the fuel plume issuing from the nozzle will follow a path based on the external surface of the projection and will pass therealong that external surface to issue from the lower extremity thereof in a substantially coaxial relation to the nozzle. The projection preferably is necked down immediately adjacent the valve member and thereafter is of a converging circular shape, generally of an inverted truncated conical shape. The projection provides a surface which aids in the control of the fuel plume shape and corrects disturbances to that shape caused by deposits in or on the surface of the nozzle port or valve member.

20 Claims, 2 Drawing Sheets

VALVE MEMBER FOR FUEL INJECTION NOZZLES

This invention relates to a valve controlled nozzle for the injection of fluid and more particularly, to a valve controlled nozzle for the injection of fuel in an internal combustion engine. In this specification the term "internal combustion engine" is to be understood to be limited to engines having an intermittent combustion cycle, such as reciprocating or rotary engines, and does not include continuous combustion engines such as turbines.

The characteristics of the fuel spray delivered from an injector nozzle to an internal combustion engine, such as directly into the combustion chamber, have a major affect on the control of the combustion process of the fuel, which in turn affects the stability of the operation of the engine, the engine fuel efficiency and the composition of the engine exhaust gases. To optimize these effects, particularly in a spark ignited engine, the desirable characteristics of the fuel spray issuing from the injector nozzle include small fuel droplet size (liquid fuels), controlled spray geometry and controlled penetration of the fuel. Further, at least at low fuelling rates, a relatively contained and evenly distributed ignitable cloud of fuel vapor in the vicinity of the engine spark plug is desirable.

Some known injector nozzles, used for the delivery of fuel directly into the combustion chamber of an engine, are of the outwardly opening poppet valve type, which deliver the fuel in the form of a cylindrical or divergent conical spray. The nature of the shape of the fuel spray is dependent on a number of factors including the geometry of the port and valve constituting the nozzle, especially the surfaces of the port and valve immediately adjacent the seat, where the port and valve engage to seal when the nozzle is closed. Once a nozzle geometry has been selected to give the required performance of the injector nozzle and the combustion process, relatively minor departures from that geometry can significantly impair that performance particularly at low fuelling rates.

The attachment or build-up of solid combustion products or other deposits on the nozzle surfaces over which the fuel flows can be detrimental to the creation of the correct fuel distribution and hence the combustion process of the engine. The principal cause of build up on these surfaces is the adhesion thereto of carbon related or other particles that are produced by the combustion of the fuel, including incomplete combustion of residual fuel left on these surfaces between injection cycles.

It is known that a hollow fuel plume issuing from a nozzle initially follows a path principally determined by the exit direction and exit velocity of the fuel. It is also known that as the fuel plume advances beyond the delivery end of the injector nozzle, the reduction in the velocity of the fuel plume and the low pressure existing within the area bound by the plume immediately downstream of the nozzle, promotes an inward contraction of the plume, referred to as necking.

It has been found that disturbances to the fuel flow from the nozzle can significantly influence the shape of the fuel plume, particularly during and subsequent to the necking thereof. Such influences can promote unpredictable deflection and/or dispersion of the fuel, which in turn can adversely affect the combustion process and thus give rise to an increase in fuel consumption, and undesirable levels of exhaust emissions, and also instability in engine operation particularly at low load operation. Disturbances that can give rise to such undesirable influences include the presence of irregular deposits on the surfaces defining the injector nozzle exit, such as carbon and other combustion related deposits, eccentricity of the valve and seat components of the nozzle, and or excessive clearance between the stem of the valve and the bore in which it axially moves as it opens and closes. Lateral movement or eccentricity of the valve and deposits on the valve or seat can each result in changes in the relative rate of flow over different sections of the periphery of the nozzle thus causing an asymmetric fuel plume.

The above discussed disturbances to the delivery of fuel to the combustion chamber of an engine are particularly significant in engines operating on a highly stratified charge such as is recognized as highly desirable to control exhaust emissions at low load operation.

It is therefore the object of the present invention to provide an injector nozzle that will contribute to improved control of the shape and direction of the fuel plume and hence improve the performance and efficiency of the injector nozzle and combustion process respectively.

With this object in view there is provided an injector nozzle for a fuel injected internal combustion engine, comprising a nozzle through which fuel is delivered to an engine, said nozzle comprising a port having an internal surface and a valve member having a complementary external surface, said valve member being movable relative to the port to respectively provide a passage between said surfaces for the delivery of fuel or sealed contract therebetween to prevent the delivery of fuel, characterized by said valve member having a projection extending beyond the extremity of the nozzle and defined by an external toroidal surface, said projection being configured and positioned such that a fuel plume established by fuel issuing from the passage will follow a path defined by the external toroidal surface of the projection.

More specifically the projection is configured and positioned such that the fuel plume issuing from the nozzle passage when the injector nozzle is open will embrace a portion of the projection adjacent the valve member and subsequently flow along a path determined by the external surface of the projection.

Conveniently, the projection has a circular cross-section and preferably converges from at least near the valve member towards the other end thereof. Conveniently, a necked portion between the valve member and the adjacent end of the projection provide a reduced cross-sectional area to thereby reduce the area through which heat in the projection can flow to the valve member and hence be dissipated through the injector nozzle to the engine cylinder or cylinder head. This necking contributes to retaining heat in the projection to thereby maintain the projection at a sufficiently high temperature to burn off any carbon or other particles deposited on the surface thereof.

The provision of the projection to aid in the control of the fuel plume created as fuel issues from the injector nozzle significantly contributes to the management of the combustion process and hence the control of exhaust emissions and fuel efficiency. The projection stabilizes the fuel plume by providing a physical surface to guide the spray downstream of the nozzle. This has the result of reducing lateral deflection of the spray oscillation during each injection cycle.

The provision of the projection extending downstream from the injector nozzle is effective in the guiding of the fuel plume as a result of the initial engagement of the plume with the projection arising from the natural inward necking of the plume a short distance after issue of the plume from the injector nozzle. Once such engagement has been established the plume will maintain contact with and be guided by the external surface of the projection due to Coanda Effect principals. The plume will thus follow a path corresponding to the external surface of the projection thereby reducing the possibility of the fuel plume displacing sideways due to unequal pressures and velocities on opposite sides of the plume.

It is to be appreciated that the guidance of the fuel plume, by the projection extending from the valve member of the nozzle, will promote uniformity in the direction of flow of the fuel plume into the engine combustion chamber, countering other influences as previously discussed that could cause irregularities or diversion of the fuel plume or parts thereof. The guidance of the fuel plume can also aid in the correction of disturbances to the plume arising from manufacturing variations including tolerance variations and departure.

The invention will be more readily understood from the following description of several practical arrangements of the fuel injector nozzle as depicted in the accompanying drawings.

Figure 1:
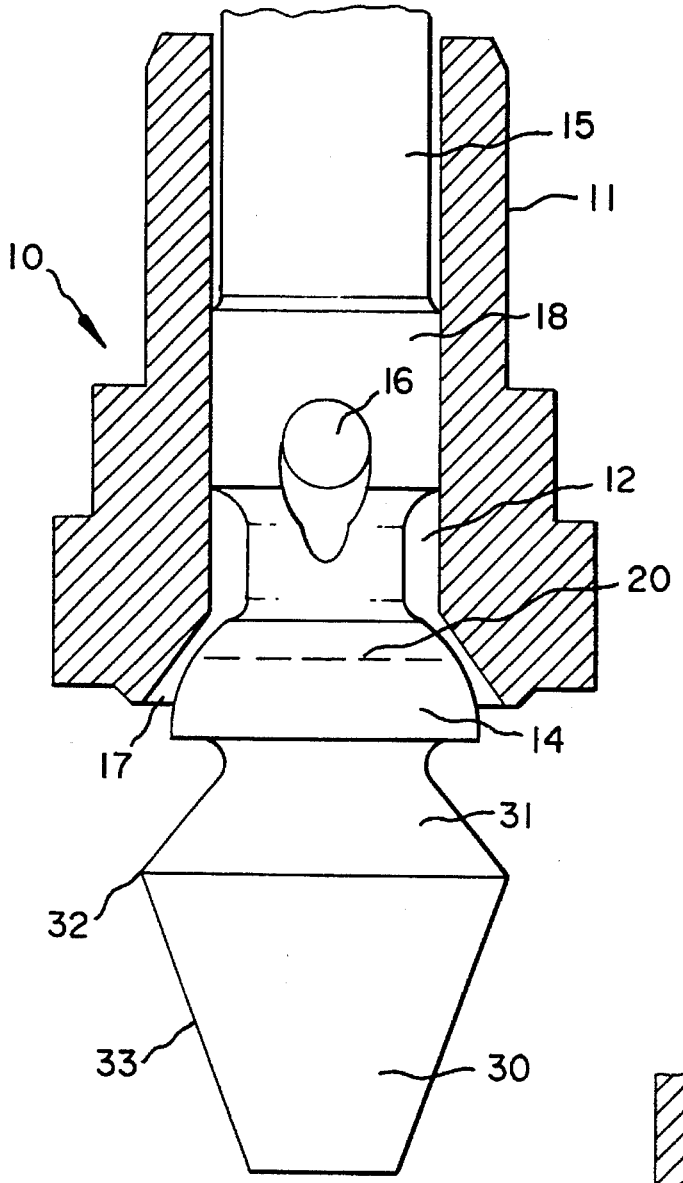
FIG. 1 is a sectional view of the nozzle portion of a fuel injector.
Figure 2:
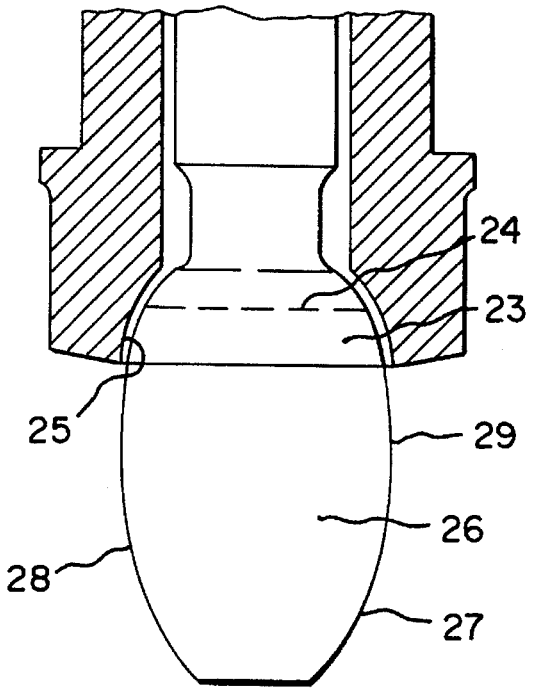
FIG. 2 is a similar sectional view of a fuel injection nozzle with an alternative from of projection.
Figure 3:
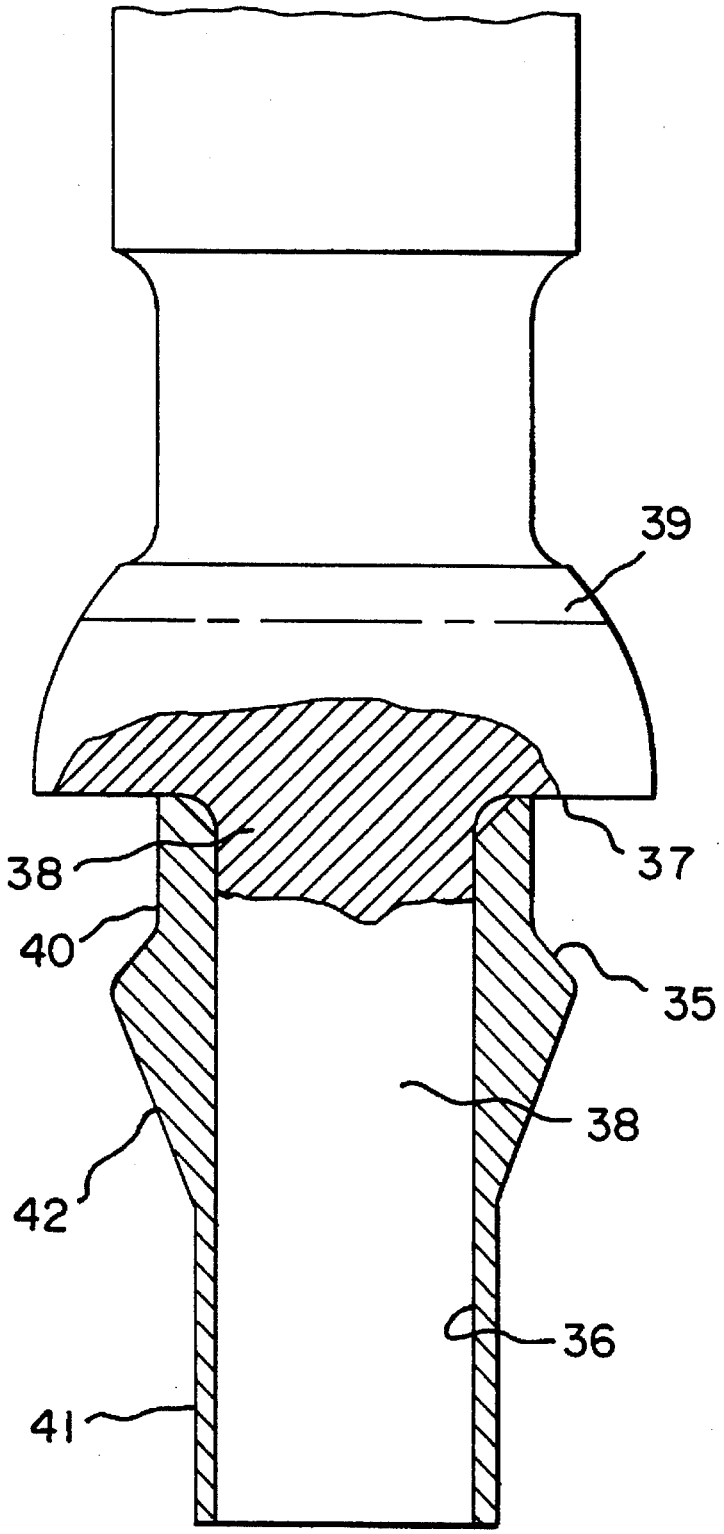
FIG. 3 is a part sectional view of a fuel injector valve fitted with another alternative form of projection.

The fuel injector nozzles as depicted in FIGS. 1, 2 and 3, and hereinafter described, can be incorporated into a wide range of fuel injectors as used for delivering fuel into the combustion chamber of an engine. Typical forms of injectors in which the nozzle in accordance with the present invention can be incorporated are disclosed in International Patent Application No. WO 88/07628 and in U.S. Pat. No. 4,844,339, both in the name of Orbital Engine Company Pty Ltd and the disclosure in each of these prior applications is hereby incorporated in the specification by reference.

Referring now to FIG. 1 of the drawings, the body 10 of the fuel injector nozzle is of a generally cylindrical shape having a spigot portion 11 which is provided to be received in a bore provided in a co-operating portion of the complete fuel injector unit. The valve 13 has a valve head 14 and a valve stem 15. The stem 15 has a guide portion 18 which is axially slidable in the bore 12 of the body 10. The stem 15 is hollow so that the fuel can be delivered therethrough, and openings 16 are provided in the wall of the stem 15 to permit the fuel to pass from the interior of the stem 15 into the bore 12.

The valve head 14 is of a part spherical form and received in the port 17 provided in the end of the body 10, and which communicates with the bore 12. The wall of the port 17 is of a frustro-conical form to be engaged by the seat line 20 of the valve head 14 when the latter is in the closed position.

The plume guide projection 30 is formed integral with the head 14 of the valve 13 and is connected thereto by the neck 31, which is of a substantially reduced cross-section to that of the plume guide projection 30 to restrict the heat flow from the guide projection and thereby raise the temperature thereof as previously referred to herein. The plume guide projection is of a truncated conical shape with the larger cross-section adjoining the neck 31.

The diameter of the end 32 of the plume guide projection nearest to the valve head is selected so that the fuel plume issuing from the valve when open will follow a path based on the external surface 33 of the guide projection. To achieve this end, the diameter of the upper end 32 is largely determined experimentally to achieve attachment of the inner boundary layer of the fuel plume to the external surface 33 of the guide projection so the fuel plume will follow a path complementary to surface 33. The configuration of the external surface of the projection may also be selected to specifically direct the fuel in a desired direction not co-axial with the injector nozzle.

If the configuration of the port and valve provide a fuel plume that diverges outward from the nozzle end face it can be desirable to have the diameter of the guide projection at the end 32 thereof adjacent the nozzle, larger than the diameter of the head 14 of the valve member 13. However the diameter at that end 32 of the guide projection 30 must not be such that that end of the guide projection extends into or through the plume issuing from the nozzle, as this would result in a breaking up or outward deflection of the plume contrary to the aim of the invention. The diameter of the guide projection adjacent the nozzle can be less than that of the valve as the plume will naturally collapse inwardly after leaving the nozzle, as previously referred to, and is thus brought into contact with the external surface of the guide projection. Likewise, the axial spacing between the end face of the valve member and the commencement of the external surface of the adjacent end 32 of the guide projection is selected to promote the attachment of the plume to the external surface of the guide projection. In some constructions the external surface of the guide projection can be a continuation of the external surface of the valve member with a smooth transition between the respective surfaces.

There is shown in FIG. 2 an alternative form of injector nozzle and projection wherein there is no reduced cross section neck between the valve member and the guide. The valve 23 is of the same construction as the valve shown in FIG. 1 being of a spherical section shape having a seat line 24 that sealably contacts the complementary seat surface 25 of the port. As shown, the valve 23 is in the open position.

The guide projection 26 is a one piece construction with the valve 23, with the external surface 27 of the guide projection being a smooth continuation of the spherical section shape of the valve. Initially the surface 27 extending from the valve 23 is divergent at 29 and smoothly translates to a convergent shape in the portion 28 remote from the valve 23.

It is to be noted that as the surface of the valve and the surface of the port are substantially co-axial and terminate at the delivery end substantially at a common diametric plane, thus the fuel plume issuing therefrom will immediately be in contact with portion 29 of the surface 27 of the guide projection and will subsequently follow a path determined by the converging portion 28 of the surface 27 towards the lower end of the projection 26 partly due to the Coanda Effect.

The valve and port configuration as illustrated in FIG. 2 can also be used in conjunction with a conical shaped guide projection either with or without a necked portion between the valve and the guide projection. In such a construction there can be an initial divergent surface blending with a subsequent converging surface.

In FIG. 3 there is illustrated a guide projection that is produced as an individual component that can be secured to a valve member adapted for such a purpose. The guide projection 35 is of a toriodal form having a central bore 36 extending the length thereof. The bore 36 receives the spigot 38 projecting centrally from the end face 37 of the valve 39 and as shown is preferably an integral part of the valve.

The guide projection 35 directly abuts the valve and the upper cylindrical portion 40 functions as a necked area when assembled to the valve. The lower cylindrical portion 41 is of a thin wall form so that it can be crimped to firmly grip the spigot 38 to provide a secure attachment thereto and to the valve 39. The downwardly converging portion 42 provides the surface to which the fuel plume will attach to be guided on a prescribed path as previously discussed.

As a modification to the construction shown in FIG. 3, the cylindrical portion 41 could be welded or otherwise secured to the spigot 38 and when welded the cylindrical portion 41 can be of shorter length or completely eliminated. A construction wherein the guide projection is not integral with the valve is beneficial in maintaining the guide projection at a high temperature due to the reduced heat transfer rate from the guide projection. The rate of heat transfer can be further reduced by increasing the clearance between the guide projection 35 and the spigot 38 or by providing insulating material 50 therebetween.

In a further modification, the guide projection can be constructed of a low heat transfer material particularly a material having a lower heat transfer rate than the stainless steel normally used for the valve of a fuel injector nozzle.

The lower cylindrical portion 41 can be a separate component from the guide projection 35 so that the guide projection 35 can have a greater clearance on the spigot 38 and hence a lower heat transfer rate to the spigot and to the valve 39. Also the greater clearance enables a limited freedom of movement of the guide projection that can assist in the shedding of foreign material deposits on the guide projection. In such construction an independent component is provided on the spigot below the guide projection that is secured to the spigot 38 to retain the guide projection correctly located on the spigot.

In each of the embodiments described the guide projection is coaxial with the valve member, however, in some application it can be appropriate to effect a small degree of deflection of the fuel plume. Accordingly, the guide projection can be appropriately inclined to the axis of the valve to provide the required deflection of the fuel plume.

It will be appreciated by those skilled in the art that the dimensions of the guide projection are influenced by a number of factors including the dimensions of the injector nozzle, the nature of the fluid or fuel and the velocity of delivery from the nozzle. Typical dimension of the projection as shown in FIG. 1 are provided below by way of example only,

| | |
|---|---|
| Valve Diameter | 5.5 mm |
| Guide Projection Small End Diameter | 2.5 mm |
| Guide Projection Included Angle | 40° |
| Guide Projection Length | 8.2 mm |

The included angle referred to above is the angle formed between opposing surfaces of the projection. The projection can have an included angle up to 50°.

The present invention is applicable to popper type fuel injector nozzle of all constructions where the fuel issues therefrom in the form of a plume including injectors where fuel alone is injected and where fuel entrained in a gas, such as air, is injected. Examples of specific nozzle constructions to which the invention can be applied are disclosed in U.S. Pat. No. 5,090,625 and International Patent Application WO91/11609 both being incorporated herein by the disclosure of each being incorporated herein by reference. Also the injector nozzle as disclosed herein can be used for injecting other fluid in addition to fuel with similar beneficial control of the fluid plume.

The claims defining the invention are as follows:

I claim:

1. An injector nozzle for use with a fuel injected internal combustion engine, comprising a nozzle through which fuel is delivered to an engine, said nozzle comprising a port having an internal surface and a valve member having a complimentary external surface, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume established by a fuel issuing from the passage will follow a path defined by the external surface of the projection, wherein in the direction of flow of the fuel, the surface of the projection initially diverges from an axis of the valve member and then converges towards the axis thereof wherein at least a substantial part of the convergent portion of the projection has an included angle of less than about 50°.

2. An injector nozzle as claimed in claim 1, wherein the external surface of the projection is convergent in the direction of flow of the fuel over at least part of the length thereof.

3. An injector nozzle as claimed in claim 1 wherein the convergent portion of the projection is substantially frusto conical.

4. An injector nozzle as claimed in claim 1 wherein the external surface of the projecting is convergent in the direction of flow of the fuel over at least part of the length thereof.

5. An injector nozzle for a fuel injected internal combustion engine, comprising a nozzle through which fuel is delivered to an engine combustion chamber, said nozzle comprising a port having an internal surface and a valve member having an external surface complimentary with respect to the internal surface of the port, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume issuing from the passage will embrace a portion of said external surface of the projection adjacent the valve member and be guided therealong on a path determined by the external surface of the projection, wherein the direction of flow of the fuel, the surface of the projection initially diverges from an axis of the valve member and then converges towards the axis thereof.

6. An injector nozzle for use with a fuel injected internal combustion engine, comprising a nozzle through which fuel is delivered to an engine, said nozzle comprising a port having an internal surface and a valve member having a complimentary external surface, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact With the port and defined by an external surface of rotation, said projection being configured and positioned such that a fuel plume established by a fuel issuing from the passage will follow a path defined by the external surface of the projection, wherein in the direction of flow of the fuel, the surface of the projection initially diverges from an axis of the valve member and then converges towards the axis thereof wherein the projection has a neck portion of reduced cross-sectional area adjacent the valve member and upstream of the location where the fuel plume initially contacts the projection when in use.

7. An injector nozzle as claimed in claim 6 wherein the projection is configured to not intersect the path of the fuel plume prior to the fuel plume embracing the projection.

8. An injector nozzle as claimed in claim 6, wherein said convergent portion of the projection extends to the extremity of the external surface.

9. An injector nozzle as claimed in 8 wherein the convergent portion of the projection is substantially frustoconical with an included angle of up to about 50°.

10. An injector nozzle as claimed in claim 6 wherein the projection has an external surface that diverges from the valve member over a first portion of the length of the projection and converges over a second portion of the length of the projection continuous from said first portion.

11. An injector nozzle as claimed in claim 6 wherein the projection is removably attached to the valve member.

12. An injector nozzle as claimed in claim 6 wherein the projection is made of a material having a low heat conductivity.

13. An injector nozzle for use with a fuel injected internal combustion engine, comprising a nozzle through which fuel is delivered to an engine said nozzle comprising a port having an internal surface and a valve member having a complimentary external surface, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume established by a fuel issuing from the passage will follow a path defined by the external surface of the projection, wherein in the direction of flow of the fuel, the surface of the projection initially diverges from an axis of the valve member and then converges towards the axis thereof wherein the projection is mounted on a spigot integral with the valve member.

14. An injector nozzle for use with a fuel injected internal combustion engine, comprising a nozzle through which fuel is delivered to an engine, said nozzle comprising a port having an internal surface and a valve member having a complimentary external surface, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume established by a fuel issuing from the passage will follow a path defined by the external surface of the projection, wherein in the direction of flow of the fuel, the surface of the projection initially diverges from an axis of the valve member and then converges towards the axis thereof wherein heat insulating means is operatively located between the projection and the valve member.

15. An injector nozzle for a fuel injected internal combustion engine, comprising a nozzle through which fuel is delivered to an engine combustion chamber, said nozzle comprising a port having an internal surface and a valve member having an external surface complimentary with respect to the internal surface of the port, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume issuing from the passage will embrace a portion of said external surface of the projection adjacent the valve member and be guided therealong on a path determined by the external surface of the projection, wherein the direction of flow of the fuel, the surface of the projection initially diverges from an axis of the valve member and then converges towards the axis thereof wherein the projection has a neck portion of reduced cross-sectional area adjacent the valve member and upstream of the location where the fuel plume initially contacts the projection when in use.

16. An injector nozzle as claimed in claim 15 wherein said convergent portion of the projection extends to an extremity of the external surface.

17. An injector nozzle as claimed in claim 15 wherein the projection is removably attached to the valve member.

18. An injector nozzle as claimed in claim 15 wherein the projection is made of a material having a low heat conductivity.

19. An injector nozzle for a fuel injected internal combustion engine, comprising a nozzle through which fuel is delivered to an engine combustion chamber, said nozzle comprising a port having an internal surface and a valve member having an external surface complimentary with respect to the internal surface of the port, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume issuing from the passage will embrace a portion of said external surface of the projection adjacent the valve member and be Guided therealong on a path determined by the external surface of the projection, wherein the direction of flow of the fuel, the surface of the projection initially diverges from an axis of the valve member and then converges towards the axis thereof wherein the projection is mounted on a spigot integral with the valve member.

20. An injector nozzle for a fuel injected internal combustion engine; comprising a nozzle through which fuel delivered to an engine combustion chamber, said nozzle comprising a port having an internal surface and a valve member having an external surface complimentary with respect to the internal surface of the port, said valve member being movable relative to the port to respectively provide a passage therebetween for a delivery of fuel or sealed contact therebetween to prevent said delivery of fuel, wherein said valve member has a projection extending beyond the extremity of the nozzle when the valve member is in sealed contact with the port and defined by an external surface of rotation, said projection being configured and positioned such that a fuel plume issuing from the passage will embrace a portion of said external surface of the projection adjacent the valve member and be guided therealong on a path determined by the external surface of the projection, wherein the direction of flow of the fuel, the surface of the projection initially diverges from an axis of the valve member and then converges towards the axis thereof wherein heat insulating means is operatively located between the projection and the valve member.

* * * * *